US006575075B2

(12) United States Patent
Cohen

(10) Patent No.: US 6,575,075 B2
(45) **Date of Patent: *Jun. 10, 2003**

(54) COMPOSITE ARMOR PANEL

(76) Inventor: Michael Cohen, Kibbutz Kfar Etzion, Mobile Post, North Yehuda 90200 (IL)

( * ) Notice: Subject to any disclaimer, the term of this patent is extended or adjusted under 35 U.S.C. 154(b) by 0 days.

This patent is subject to a terminal disclaimer.

(21) Appl. No.: 09/924,745

(22) Filed: Aug. 7, 2001

(65) Prior Publication Data

US 2002/0012768 A1 Jan. 31, 2002

(30) Foreign Application Priority Data

Oct. 5, 2000 (IL) ..... 138897

(51) Int. Cl.[7] ..... F41H 5/04; F41H 1/02
(52) U.S. Cl. ..... 89/36.02; 89/36.05
(58) Field of Search ..... 89/36.02, 36.05, 89/36.08, 36.07; 2/2.5; 428/911

(56) References Cited

U.S. PATENT DOCUMENTS

| | | | | | |
|---|---|---|---|---|---|
| 1,463,498 | A | * | 7/1923 | Burgess | 109/80 |
| 3,431,818 | A | * | 3/1969 | King | 109/80 |
| 3,523,057 | A | * | 8/1970 | Buck | 109/24 |
| 3,705,558 | A | * | 12/1972 | McDougal et al. | 109/84 |
| 4,179,979 | A | * | 12/1979 | Cook et al. | 109/49.5 |
| 4,665,794 | A | * | 5/1987 | Gerber et al. | 109/84 |
| 5,134,725 | A | * | 8/1992 | Yeshurun et al. | 2/102 |
| 5,364,679 | A | * | 11/1994 | Groves | 109/49.5 |
| 5,738,925 | A | * | 4/1998 | Chaput | 2/2.5 |
| 5,763,813 | A | * | 6/1998 | Cohen et al. | 109/84 |
| 5,972,819 | A | * | 10/1999 | Cohen | 428/911 |
| 6,112,635 | A | * | 9/2000 | Cohen | 428/911 |
| 6,203,908 | B1 | * | 3/2001 | Cohen | 428/397 |
| 6,289,781 | B1 | * | 9/2001 | Cohen | 428/911 |
| 6,408,734 | B1 | * | 6/2002 | Cohen | 89/36.02 |

FOREIGN PATENT DOCUMENTS

| | | | | |
|---|---|---|---|---|
| EP | 0959321 | A1 | * | 11/1999 |
| WO | WO 83/03298 | A1 | * | 9/1983 |
| WO | WO 99/53260 | A1 | * | 10/1999 |
| WO | WO 02/29351 | A1 | * | 4/2002 |

* cited by examiner

*Primary Examiner*—Charles T. Jordan
*Assistant Examiner*—John W. Zerr
(74) *Attorney, Agent, or Firm*—Fulbright & Jaworski L.L.P.

(57) ABSTRACT

A composite armor plate for absorbing and dissipating kinetic energy from high velocity projectiles including an internal layer of pellets, which are bound and retained in plate form by a solidified material such that the pellets are in a plurality of adjacent rows. The pellets have a specific gravity of at least 2 and are made from glass, sintered refractory material or ceramic material. The majority of the pellets have at least one axis of at least 3 mm length and are bound such that a majority of the pellets is in contact with six adjacent pellets in the same layer to provide mutual lateral confinement therebetween. The pellets have a substantially regular geometric form, wherein the solidified material and the plate are elastic. A channel is provided in a plurality of the pellets, substantially opposite to an outer impact-receiving major surface of the plate, thereby reducing the weight of the pellets.

18 Claims, 3 Drawing Sheets

COMPOSITE ARMOR PANEL

The present invention relates to composite armor plates and panels. More particularly, the invention relates to an armored plate which may be worn to provide the user with lightweight ballistic protection, as well as to armored plates for providing ballistic protection for light and heavy mobile equipment and vehicles against high-speed projectiles or fragments.

The present invention is a modification of the inventions described in European patent application 96308166.6 (EP-A-0843149), European patent application 98301769.0, International patent application PCT/GB97102743 (WO-A-98/15796), WO 99/60327 and WO99/53260.

In EP-A-0843149 there is described a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of superposed rows, characterized in that the pellets have an $Al_2O_3$ content of at least 85%, preferably at least 93%, and a specific gravity of at least 2.5, the majority of the pellets each have at least one axis in the range of about 3–12 mm, and are bound by said solidified material in a single internal layer of superposed rows, wherein a majority of each of said pellets is in direct contact with at least 4 adjacent pellets, the total weight of said plate does not exceed 45 kg/m$^2$ and said solidified material and said plate are elastic.

In European patent application 98301769.0 there is described and claimed a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of adjacent rows, characterized in that the pellets have an $Al_2O_3$ content of at least 93% and a specific gravity of at least 2.5, the majority of the pellets each have at least one axis of at least 12 mm length and are bound by said solidified material in a single internal layer of adjacent rows, wherein a majority of each of said pellets is in direct contact with at least 4 adjacent pellets, and said solidified material and said plate are elastic.

In WO-A-9815796 there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

In WO 99/60327 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least six adjacent pellets in the same layer to provide mutual lateral confinement therebetween, said pellets each have a substantially regular geometric form and said solidified material and said plate are elastic.

In WO 99/53260 there is described and claimed a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

The teachings of all five of these specifications are incorporated herein by reference.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described.

Ceramic materials are nonmetallic, inorganic solids having a crystalline or glassy structure, and have many useful physical properties, including resistance to heat, abrasion and compression, high rigidity, low weight in comparison with steel, and outstanding chemical stability. Such properties have long drawn the attention of armor designers, and solid ceramic plates, in thicknesses ranging from 7 mm. for personal protection to 9 mm. for heavy military vehicles, are commercially available for such use.

Much research has been devoted to improving the low tensile and low flexible strength and poor fracture toughness of ceramic materials; however, these remain the major drawbacks to the use of ceramic plates and other large components which can crack and/or shatter in response to the shock of an incoming projectile.

Light-weight, flexible armored articles of clothing have also been used for many decades, for personal protection against fire-arm projectiles and projectile splinters. Examples of this type of armor are found in U.S. Pat. No. 4,090,005. Such clothing is certainly valuable against low-energy projectiles, such as those fired from a distance of several hundred meters, but fails to protect the wearer against high-velocity projectiles originating at closer range and especially does not protect against armor-piercing projectiles. If made to provide such protection, the weight and/or cost of such clothing discourages its use. A further known problem with such clothing is that even when it succeeds in stopping a projectile the user may suffer injury due to indentation of the vest into the body, caused by too small a body area being impacted and required to absorb the energy of a bullet.

A common problem with prior art ceramic armor concerns damage inflicted on the armor structure by a first projectile, whether stopped or penetrating. Such damage weakens the armor panel, and so allows penetration of a following projectile, impacting within a few centimeters of the first.

The present invention is therefore intended to obviate the disadvantages of prior art ceramic armor, and in a first embodiment to provide an armor plate which is effective against small-caliber fire-arm projectiles, yet is of light weight, i.e, having a weight of less than 45 kg/m$^2$ (which is equivalent to about 9 lbs/ft$^2$) and low bulk.

In other embodiments the present invention provides an armor plate which is effective against a full range of armor-piercing projectiles from 5.56 mm and even up to 30 mm, as well as from normal small-caliber fire-arm projectiles, yet is of light weight, i.e., having a weight of less than 185 kg/m$^2$, even for the heavier armor provided for dealing with 25 and 30 mm projectiles.

A further object of the invention is to provide an armor plate or panel which is particularly effective in arresting a plurality of armor-piercing projectiles impacting upon the same general area of the panel.

The armor plates described in EP-A-0843149 and European patent application 98301769.0 are made using ceramic pellets made substantially entirely of aluminum oxide. In WO-A-9815796 the ceramic bodies are of substantially cylindrical shape having at least one convexly-curved end-face, and are preferably made of aluminum oxide.

In WO 99/60327 it was described that the improved properties of the plates described in the earlier patent applications of this series is as much a function of the configuration of the pellets, which are of regular geometric form with at least one convexly-curved end face (for example, the pellets may be spherical or ovoidal, or of regular geometric cross-section, such as hexagonal, with at least one convexly-curved end face), said panels and their arrangement as a single internal layer of pellets bound by an elastic solidified material, wherein each of a majority of said pellets is in direct contact with at least four adjacent pellets and said curved end face of each pellet is oriented to substantially face in the direction of an outer impact-receiving major surface of the plate. As a result, said specification teaches that composite armor plates superior to those available in the prior art can be manufactured using glass pellets which have a specific gravity of only 2, or pellets made of sintered refractory materials or ceramic materials having a specific gravity below that of aluminum oxide, e.g., boron carbide with a specific gravity of 2.45. silicon carbide with a specific gravity of 3.2 and silicon aluminum oxynitride with a specific gravity of about 3.2.

Thus, it was described in said publication that sintered oxides, nitrides, carbides and borides of magnesium, zirconium, tungsten, molybdium, titanium and silica can be used and especially preferred for use in said publication and in the present invention are pellets selected from the group consisting of glass, boron carbide, titanium diboride, silicon carbide, silicon oxide, silicon nitride, magnesium oxide, silicon aluminum oxynitride in both its alpha and beta forms and mixtures thereof.

With increase in specific gravity the stopping power of the plates increases so that those plates utilizing pellets of higher specific gravity are also useful for absorbing and dissipating kinetic energy from high-velocity armor-piercing bullets.

Accordingly, WO 99/60327 provided a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material and ceramic material which does not contain or is not predominantly aluminum oxide, the majority of the pellets each have at least one axis of at least 3 mm length and are bound by said solidified material in said single internal layer of adjacent rows such that each of a majority of said pellets is in direct contact with at least 4 adjacent pellets, said pellets each have a substantially regular geometric form and have at least one convexly-curved end face oriented to substantially face in the direction of an outer impact receiving major surface of said plate, and said solidified material and said plate are elastic.

After further research and development it was surprisingly discovered that the weight of the pellets described in said previous specifications can be further reduced without affecting the stopping power of a plate formed therefrom by providing a channel in said pellets substantially opposite to an outer impact-receiving major surface of the composite armor plate incorporating the same.

Thus, according to the present invention there is now provided a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, the majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form, wherein said solidified material and said plate are elastic, characterized in that a channel is provided in each of a plurality of said pellets, substantially opposite to an outer impact-receiving major surface of said plate, thereby reducing the weight per area of each of said pellets.

In preferred embodiments of the present invention each of said channels occupies a volume of up to 25% within its respective pellet.

Said channels can be bored into preformed pellets or the pellets themselves can be pressed with said channel already incorporated therein.

As described in U.S. Pat. No. 5,763,813, said pellets are preferably of a geometric form having at least one convexly-curved end face and in accordance with the present invention said channels are preferably of a shape selected from the group consisting of cylindrical, pyramidal, hemispherical and quadratic, hexagonal prism and combinations thereof.

As is known, there exists a ballistic effect known in the art in which a projectile striking a cylinder at an angle has a tendency to move this cylinder out of alignment causing a theoretical possibility that a second shot would have more penetration effect on a panel.

In the preferred embodiments of the present invention said solidified material extends into said channels and provides enhanced alignment and adherence of the channel containing pellets within said plate.

In especially preferred embodiments of the present invention each of said channels occupies a volume of up to 20% within its respective pellet.

As will be realized, since material is removed from the pellets of the present invention their weight is decreased, as is the overall weight of the entire composite armor plate from which they are formed, thereby providing the unexpected improvement of reduced weight of protective armor panels without loss of stopping power, as shown in the examples hereinafter.

In some preferred embodiments of the invention the majority of the pellets each have at least one axis having a length in the range of about 3–19 mm, and the total weight of said plate does not exceed 45 kg/m$^2$.

In other preferred embodiments of the invention the majority of said pellets each have at least one axis having a length in the range of from about 20 to 60 mm and the weight of said plate does not exceed 185 kg/m$^2$.

In preferred embodiments of the present invention said pellets each have a major axis and said pellets are arranged with their major axes substantially parallel to each other and oriented substantially perpendicularly relative to said outer impact-receiving major surface of said panel. The pellets need not be of circular cross-section.

The solidified material can be any suitable material which retains elasticity upon hardening at the thickness used, such as aluminum, epoxy, a thermoplastic polymer such as polycarbonate, or a thermoset plastic, thereby allowing curvature of the plate without cracking to match curved surfaces to be protected, including body surfaces, as well as elastic reaction of the plate to incoming projectiles to allow increased contact force between adjacent pellets at the point of impact.

In French Patent 2,711,782, there is described a steel panel reinforced with ceramic materials; however, due to the rigidity and lack of elasticity of the steel of said panel, said panel does not have the ability to deflect armor-piercing projectiles unless a thickness of about 8–9 mm of steel is used, which adds undesirable excessive weight to the panel and further backing is also necessary thereby further increasing the weight thereof.

It is further to be noted that the elasticity of the material used in preferred embodiments of the present invention serves, to a certain extent, to increase the probability that a projectile will simultaneously impact several pellets, thereby increasing the efficiency of the stopping power of the plate of the present invention.

According to a further aspect of the invention, there is provided a multi-layered armor panel, comprising an outer, impact-receiving layer formed by a composite armor plate as hereinbefore defined for deforming and shattering an impacting high velocity projectile; and an inner layer adjacent to said outer layer and, comprising an elastic material for absorbing the remaining kinetic energy from said fragments. Said elastic material will be chosen according to cost and weight considerations and can be made of any suitable material, such as aluminum or woven or non-woven textile material.

In especially preferred embodiments of the multi-layered armor panel, the inner layer adjacent to said outer layer comprises a tough woven textile material for causing an asymmetric deformation of the remaining fragments of said projectile and for absorbing the remaining kinetic energy from said fragments, said multi-layered panel being capable of stopping three projectiles fired sequentially at a triangular area of said multi-layered panel, wherein the height of said triangle is substantially equal to three times the length of the axis of said pellets.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention, in which each of the pellets is in direct contact with at least four and preferably six adjacent pellets.

U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

In U.S. Pat. Nos. 3,523,057 and 5,134,725 there are described further armored panels incorporating ceramic and glass balls; however, said panels are flexible and it has been found that the flexibility of said panels substantially reduces their stopping strength upon impact, since the force of impact itself causes a flexing of said panels and a reduction of the supporting effect of adjacent constituent bodies on the impacted constituent body, due to the arrangement thereof in said patent. Thus, it will be noted that the teachings of U.S. Pat. No. 5,134,725 is limited to an armor plate having a plurality of constituent bodies of glass or ceramic material which are arranged in at least two superimposed layers, which arrangement is similar to that seen in U.S. Pat. No. 3,705,558. In addition, reference to FIGS. 3 and 4 of said patent show that pellets of a first layer do not contact pellets of the same layer and are only in contact with pellets of an adjacent layer and therefore do not benefit from the support of adjacent pellets in the same layer to provide mutual lateral confinement of the pellets, as taught in the present invention.

As will be realized, none of said prior art patents teaches or suggests the possibility of introducing channels into pellets forming an armor panel and the surprising and unexpected stopping power of a single layer of ceramic or glass pellets in direct contact with each other which, as will be shown hereinafter, successfully prevents penetration of fire-arm projectiles despite the relative light weight of the plate incorporating said pellets and the channels introduced therein.

Thus, it has been found that the novel armor of the present invention traps incoming projectiles between several pellets which are held in a single layer in rigid mutual abutting and laterally-confining relationship. The relatively moderate size of the pellets ensures that the damage caused by a first projectile is localized and does not spread to adjoining areas, as in the case of ceramic plates and the channels do not diminish the stopping power of the individual pellets, even though common sense would suggest that such channels would weaken the same.

An incoming projectile may contact the pellet array in one of three ways:

1. Center contact. The impact allows the full volume of the pellet to participate in stopping the projectile, which cannot penetrate without pulverizing the whole pellet, an energy-intensive task. The pellets used are either spheres or other regular geometric shapes having at least one convexly-curved end face, said end face being oriented to substantially face in the direction of an outer impact receiving major surface of said plate and the opposite side of which pellet is provided with said channel and this form, when supported in a matrix of pellets, as shown, e.g. in the FIGS. attached hereto, has been found to be effective in arresting ballistic projectiles.
2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the matrix, and penetration is prevented.

An additional preferred embodiment according to the present invention is one wherein the ceramic material is SiAlON in its alpha structure of $Si_{6-z}Al_zO_zN_{8-z}$, in which "z" is a substitution coefficient of Al and O in the $Si_3N_4$ and the "beta structure" of the formula $Me_{m/val}Si_{12-(m+n)}Al_{m+n}O_nN_{16-n}$, wherein Me is a metal such as Li, Mg, Ca, Y, and lanthanide's, m and n are substitution coefficients and val is the valency of the metal.

The invention will now be described in connection with certain preferred embodiments with reference to the following illustrative FIGS. so that it may be more fully understood.

With reference now to the FIGS. in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
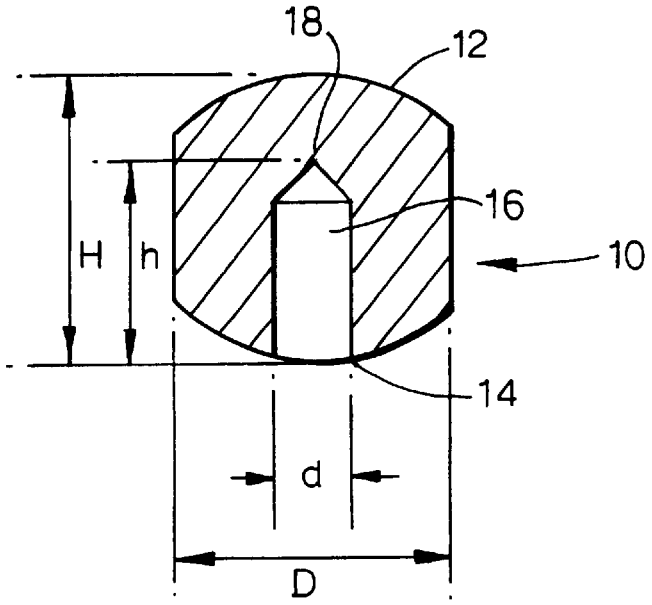
FIG. 1 is a cross-sectional side view of a cylindrical pellet according to the present invention, having two convex end faces and having a cylindrical channel with a pyramidal end provided in one of said end faces.

There is seen is FIG. 1 a ceramic body 10 for deployment in a composite armor panel, the body 10 is substantially cylindrical in shape and has two convexly-curved end faces 12 and 14. The body is provided with a channel 16 cylindrical in shape and provided with a pyramidal-like end 18. As illustrated in the FIG., the ratio between the height h of the channel and the height H of the ceramic body 10 is about 66%, while the ratio of the diameter d of the channel and the diameter D of the ceramic body is about 43%.

Figure 2:
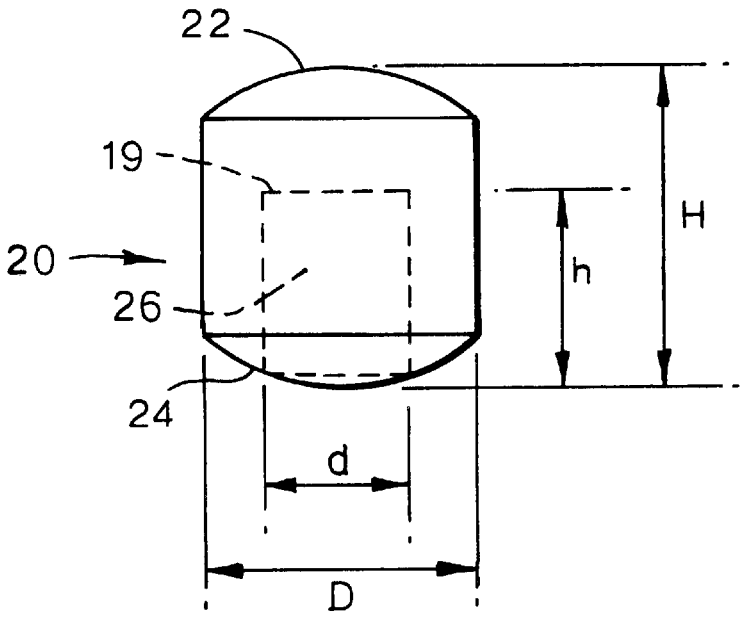
FIG. 2 is a cross-sectional side view of a cylindrical pellet according to the present invention, having two convex end faces and having a cylindrical channel provided in one of said end faces.

There is seen in FIG. 2 a ceramic body 20 for deployment in a composite armor panel, the body 20 is substantially cylindrical in shape and has two convexly-curved end faces 22 and 24. The body is provided with a channel 26 cylindrical in shape and provided with a flat end 19. As illustrated in the FIG., the ratio between the height h of the channel and the height H of the ceramic body 20 is about 62.7%, while the ratio of the diameter d of the channel and the diameter D of the ceramic body is about 40.85%.

Figure 3:
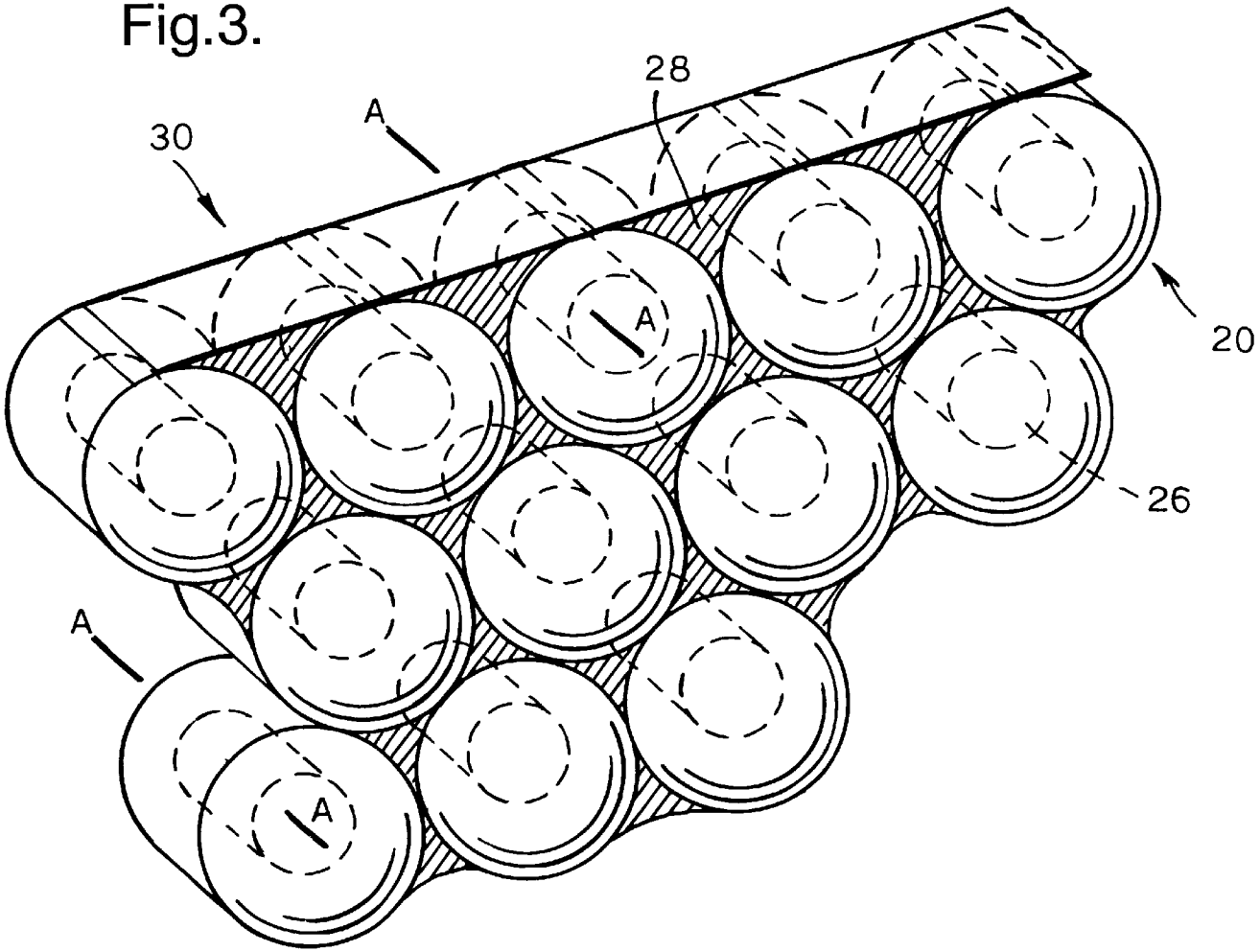
FIG. 3 is a perspective view of a small section of a panel having a plurality of pellets according to FIG. 1 provided therein.

There is seen in FIG. 3 a composite armor plate 30 for absorbing and dissipating kinetic energy from fire-arm projectiles (not shown), said plate comprising a single internal layer of pellets 20 according to FIG. 2, with channels 26 formed therein, said pellets being arranged in a single layer of adjacent rows, wherein each of a majority of said pellets is in direct contact with at least 6 adjacent pellets. As seen, the entire array of pellets is bound in said single layer of a plurality of adjacent rows by solidified epoxy 28 and said plate 30 is further provided with an inner backing layer (not shown) made of polyethylene fibers sold under the trademark DYNEEMA® or tough light arimid synthetic fibers sold under the trademark KEVLAR® or of similar material, to form a multi-layered armored panel.

The nature of the solidified material 28 is selected in accordance with the weight, performance and cost considerations applicable to the intended use of the armor.

Armor for land and sea vehicles is suitably made using a metal casting alloy containing at least 80% aluminum. A suitable alloy is Aluminum Association No. 535.0, which combines a high tensile strength of 35,000 kg/in$^2$ with excellent ductility, having 9% elongation. Further suitable alloys are of the type containing 5% silicon B443.0. These alloys are easy to cast in thin sections; their poor machinability is of little concern in the application of the present invention. An epoxy or other plastic or polymeric material, advantageously fiber-reinforced, is also suitable.

Table 1 is a reproduction of a test report relating to epoxy-bound multi-layer panels as described above with reference to FIG. 3, wherein said panel had a dimension of 20.3×19.9 cm and a thickness of 21 cm.

Figure 4:
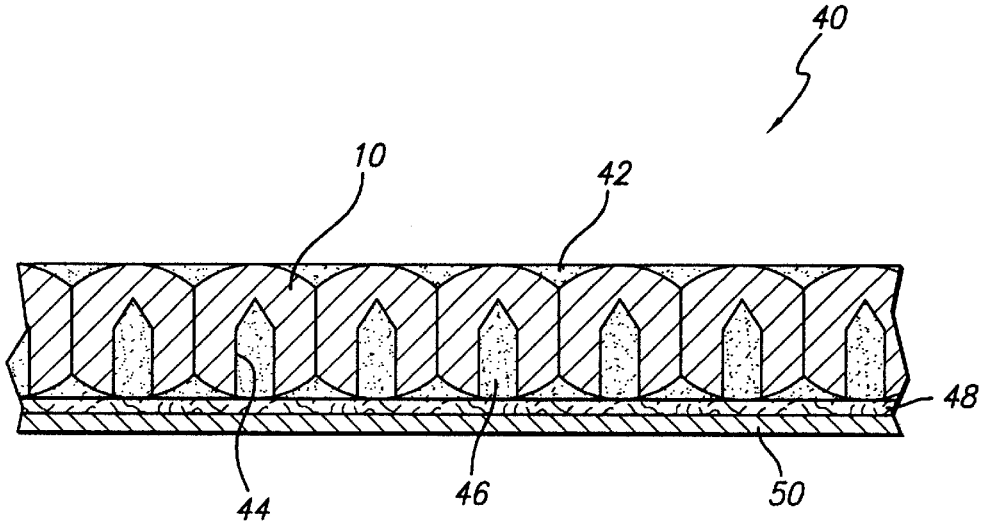
FIG. 4 is a partial.cross-sectional view of a multi-layered armor panel including pellets as shown in FIG. 1.

There is seen in FIG. 4 a partial cross-sectional view of a multi-layered armor panel 40 utilizing a plurality of pellets 10 of the type illustrated in FIG. 1. As is therein shown, the pellets are retained in plate form by a solidified material 42 such as a solidified epoxy. As is illustrated in FIG. 4, the solidified epoxy also enters the channels 44 formed in the pellets 10 as is illustrated at 46. Also included in the panel 40 is an inner layer 48 of tough woven textile material which may be made of polyethylene fibers or tough light arimid synthetic fibers or other materials having similar characteristics. If desired, the panel 40 may also include a backing layer 50 of aluminum or similar material.

The panel was impacted by a series of five AK47 armor-piecing projectiles and then by a series of three further 5.56 mm projectiles fired at 0° elevation and at a distance of 13.5 meters from the target.

None of the 8 projectiles penetrated the panel.

TABLE 1

| | |
|---|---|
| | Test date" Nov. 8, 2000 |
| TEST PANEL | |
| Description: Liba M3 B | |
| Manufacturer: Mofet | Sample No.: 1 |
| Size: 20.3 × 19.9 cm | Weight: 1.52 kg |
| Thicknesses: | Hardness: |

TABLE 1-continued

| | |
|---|---|
| Avg. Thick: 21 | Piles/Laminates: |
| AMMUNITION | |
| (1): AK 47 API | Lot No.: 71-83 |
| (2): 5.56 193 | Lot No.: wcc98 |
| (3): | Lot No.: |
| (4): | Lot No.: |
| SET-UP | |
| Vel. Screens: 1.8 m | |
| Shot Spacing: | Range to Target: 13.5 m |
| Barrel No./Gun: Barrel | Backing Material: |
| Witness Panel: Aluo 0.5 mm | Conditions: |
| APPLICABLE STANDARDS OR PROCEDURES | |
| (1): | |
| (2); | |
| (3): | |

| Shot. No | Ammu-nition | Velocity ft/sec | Velocity m/sec | Penetra-tion | Trauma mm | Obliquity |
|---|---|---|---|---|---|---|
| 1 | 1 | 2413.00 | 735.48 | none | | 0 |
| 2 | 1 | 2417.00 | 736.70 | none | | 0 |
| 3 | 1 | 2397.00 | 730.61 | none | | 0 |
| 4 | 1 | 2371.00 | 722.68 | none | | 0 |
| 5 | 1 | 2392.00 | 729.08 | none | | 0 |
| 6 | 2 | 3442.00 | 1049.1 | none | | 0 |
| 7 | 2 | 3432.00 | 1046.07 | none | | 0 |
| 8 | 2 | 3432.00 | 1046.07 | none | | 0 |

COMMENTARY:

1. shot No 3–15 mm from edge.

As will be noted, the pellets according to the present invention, when arranged in a single layer, enable the preparation of a composite armor plate which can withstand multiple impacts in a relatively small area, which multi-impact protection, despite the inclusion of weight-reducing channels in each of the pellets forming said panel It will be evident to those skilled in the art that the invention is not limited to the details of the foregoing illustrated embodiments and that the present invention may be embodied in other specific forms without departing from the scope of the invention as defined by the appended claims.

What is claimed is:

1. A composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, a majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form and first and second end faces, wherein said solidified material and said plate are elastic, characterized in that a channel is provided in said first end face of each of a plurality of said pellets, said first end face being disposed substantially opposite to an outer impact-receiving major surface of said plate, thereby reducing the weight per area of each of said pellets which channel occupies a volume of up to 25% within its respective pellet.

2. A composite armor plate according to claim 1, wherein said channels are of a shape selected from the group consisting of cylindrical, pyramidal, hemispherical and quadratic or hexagonal prism.

3. A composite armor plate according to claim 1, wherein said solidified material extends into said channels and provides enhanced alignment and adherence of the channel containing pellets within said plate.

4. A composite armor plate according to claim 1, wherein each of said channels occupies a volume of up to 20% within its respective pellet.

5. A composite armor plate according to claim 1, wherein a majority of said pellets each have at least one axis having a length in the range of from 3 to 19 mm, and said plate does not exceed 45 $kg/m^2$ in weight.

6. A composite armor plate as claimed in claim 1 for absorbing and dissipating kinetic energy from high velocity armor piercing projectiles, wherein said pellets are made of a material selected from the group consisting of alumina, boron carbide, boron nitride, titanium diboride, silicon carbide, silicon oxide, silicon nitride, magnesium oxide, silicon aluminum oxynitride and mixtures thereof.

7. A composite armor plate according to claim 1, wherein a majority of a said pellets each have at least one axis having a length in the range of from 20 to 60 mm, and said plate does not exceed 45 $kg/m^2$ in weight.

8. A composite armor plate as claimed in claim 1, wherein a majority of said pellets each has a major axis having a length in the range of from 20 to 30 mm.

9. A composite armor plate as claimed in claim 1, wherein said pellets are spherical.

10. A composite armor plate as claimed in claim 1, wherein said pellets have a hardness of at least 9 on the Mohs scale.

11. A composite armor plate as claimed in claim 1, wherein said pellets each have a major axis and said pellets are arranged with their major axes substantially parallel to each other and oriented substantially perpendicularly relative to said outer impact-receiving major surface of said panel.

12. A composite armor plate as claimed in claim 1, wherein said solidified material is a thermoplastic resin.

13. A composite armor plate as claimed in claim 1, wherein said pellets are made of SiAlON.

14. A multi-layered armor panel comprising:

an outer, impact-receiving layer formed by a composite armor plate according to claim 1 for deforming and shattering an impacting high velocity projectile into a plurality of fragments; and an inner layer adjacent to said outer layer, said inner layer comprising a tough woven textile material for causing an asymmetric deformation of fragments of said projectile land for absorbing kinetic energy from said fragments, said multi-layered panel being capable of stopping three projectiles-fired sequentially at a triangular area of said multi-layered panel, wherein the height of said triangular area is substantially equal to three times the length of the axis of said pellets.

15. A multi-layered armor panel according to claim 14, wherein said inner layer is made of polyethylene fibers.

16. A multi-layered armor panel according to claim 14, wherein said inner layer is made of tough light armid synthetic fibers.

17. A multi-layered armor panel according to claim 14, wherein said inner layer comprises multiple layers of a polyamide netting.

18. A multi-layered armor panel according to claim 14, comprising a further backing layer of aluminum.

* * * * *